United States Patent [19]

López Quintela et al.

[11] Patent Number: 4,983,217

[45] Date of Patent: Jan. 8, 1991

[54] PROCESS TO OBTAIN ULTRA FINE MAGNETIC ND-FE-B PARTICLES OF VARIOUS SIZES

[75] Inventors: Manuel A. López Quintela; José Rivas Rey, both of Santiago de Compostela; José Quibén Solla, Pontevedra, all of Spain

[73] Assignee: University of Santiago de Compostela, Spain

[21] Appl. No.: 440,890

[22] Filed: Nov. 22, 1989

[30] Foreign Application Priority Data

Nov. 24, 1988 [ES] Spain ..... 8803592

[51] Int. Cl.[5] ..... C22B 11/04

[52] U.S. Cl. ..... 75/739; 75/371

[58] Field of Search ..... 75/739, 371

[56] References Cited

U.S. PATENT DOCUMENTS 3,768,994 10/1973 Daiga ..... 75/371

*Primary Examiner*—Peter D. Rosenberg

*Attorney, Agent, or Firm*—Ostrolenk, Faber, Gerb & Soffen

[57] ABSTRACT

Process to obtain ultra fine magnetic Nd-Fe-B particles of various sizes, which can cause a reaction in different kinetic conditions, between compounds of Nd, Fe and B in the sine of micro-emulsions formed by water, oil and a surface-active agent, in different thermodynamic conditions.

11 Claims, 3 Drawing Sheets

PROCESS TO OBTAIN ULTRA FINE MAGNETIC ND-FE-B PARTICLES OF VARIOUS SIZES

BACKGROUND OF THE INVENTION

1. Field of the Invention

This invention refers to a new method of obtaining ultra fine magnetic Nd-Fe-B particles of various sizes. This method is based on carrying out the particle formation reaction in the sine of micro-reactors, in such a way that the volume of these restrict the maximum size of the particles to be formed, in addition it being able to obtain various particle sizes by modifying the size of the micro-reactors used for the reaction process.

In order to obtain particles of the desired size, it is necessary to use micro-reactors with a homogenous and easily changeable size. These characteristics are present in micro-emulsions.

Micro-emulsions are thermodynamically stable systems, formed by at least three components; two immiscible substances (usually water and oil) and a third component acting as a surface-active or amphiphile agent, able to solubilise the two former substances. The surface-active agents are molecules having a polar part (head) and an apolar part (tail), due to which they are able to solubilise two immiscible substances such as water (polar) and an oil (apolar).

2. Description of the Related Art

From a microscopic view, micro-emulsions are micro-heterogeneous systems with structures dependent on the water/oil ratio, by means of which they are classified into two types of micro-emulsion. The oil/water (oil in water) micro-emulsions are those containing a greater amount of aqueous solution and structurally they are formed by micro-drops of oil surrounded by the amphiphile molecules submerged in the aqueous medium (FIG. 1). The w/o (water in oil) micro-emulsions have a greater proportion of oil and from a microscopic view consist of dispersed aqueous micro-drops surrounded by molecules of amphiphile in the sine of the oil (FIG. 2).

The size of the micro-drops is dependent on the composition of the micro-emulsion and, for a specific micro-emulsion, variation occurs with temperature changes. See H. F. Heicke, *Micro-emulsions*, ed. I. D. Robb, page 17 (Plenum Press, N.Y., 1982); P. D. I. Fletcher, B. H. Robinson, F. Bermejo-Barrera and D. G. Oakenfull, *Micro-emulsions*, ed. I. D. Robb, page 221 (Plenum Press, N.Y., 1982); B. H. Robinson, Ch. Toprakcioglu, J. A. Dore and P. Chieux, *J. Chem. Soc. Faraday Trans.* I. 80, 413 (1984); J. S. Huang, S. T. Milner, B. Farago and D. Richter, *Phys. Rev. Let.* 59, 2600 (1987); M. Kotlarchyk, R. B. Stephens and J. S. Huang, *J. Phys. Chem.* 92, 1533 (1988); A. N. North, J. C. Dore, A. Katsikides, J. A. McDonald and B. H. Robinson, *Chem. Phys. Let.* 132, 541 (1986); and G. Fourche, A. M. Bellog and S. Brunetti, *J. Colloid, Interface Sci.* 88, 302 (1982).

Given that the magnetic Nd-Fe-B particles are formed by means of a chemical reaction in an aqueous medium, the aqueous micro-drops have a w/o micro-emulsion which comprise ideal micro-reactors to obtain such particles. If the reagents are ionic or polar, they will only be seen in the aqueous solution forming part of the micro-emulsion. The reaction will only take place within the aquous micro-drop and its volume will restrict the size of the final particle. The reaction produces a crystallization nucleous inside the micro-drop, which continues to grow by means of agglomeration until it forms a final micro-particle of a size approximately equal or less than the size of the micro-drop (FIG. 3).

For a specific composition and temperature, the micro-emulsions are formed by micro-drops of homogenous volume and, therefore, the particles obtained by a micro-emulsion reaction will also be of homogenous size. The size of a micro-emulsion's micro-drops can be varied by modifying its composition or, simply, its temperature. In this way, it is possible to avail of the adequate micro-reactors to obtain the micro-particles of the desired radius.

SUMMARY OF THE INVENTION

In accordance with this invention, in order to obtain the ultra fine magnetic Nd-Fe-B particles, a formation reaction is carried out of the mentioned aqueous micro-drops of a w/o micro-emulsion of the appropriate size.

DETAILED DESCRIPTION OF THE PREFERRED EMBODIMENT

By way of example, the following explains how to obtain, in accordance with this invention, particles of Nd-Fe-B with a radius of approximately 70 A. The micro-emulsions used are formed by Isoctane/Aerosol OT [bis(2-ethylhexyl)sodium sulfosuccionate]/water with a concentration of 0.1 M of AOT, a ratio $R=[H_2O]/[AOT]$of 30 and a temperature of 25° C. In these conditions, the micro-emulsions are formed by aqueous micro-drops with an approximate radius of 70 A[1]. Therefore, by causing a reaction of the compounds Nd, Fe and B in the aqueous micro-drops of the former micro-emulsion, particles will be obtained with a radius approximately equal to or less than 70 A.

When studying the magnetic properties of the Nd, Fe and B compounds, it is seen that the alloy of the composition $Nd_{1,6}Fe_{7,6}B_8$ is ideal for use in applications at room temperature (see I. V. Mitchell, in Nd-Fe Permanent Magnets, Their Present and Future Applications (Elsevier Applied Science Publishers, 1985); and G. C. Hadjipanayis and C. N. Christodoulou, J. Magn. Mat. 71, 235 (1988). In order to obtain particles of this composition, an aqueous solution of Iron Chloride (III) and Neodymium Chloride (III) is prepared, in such a way that the ratio $Fe^{2+}/Nd^{3+}$ is the same as that seen in the previous alloy (76/16).

The micro-emulsion of Isoctane/AOT/Water is prepared with the characteristics mentioned above, but substituting the water portion for the same amount of aqueous solution $Fe^{2+}$ and $Nd^{3+}$, and this is kept at a temperature of 25° C. Then, the necessary amount of Sodium borohydride is added to reduce the number of $Fe^{2+}$ and $Nd^{3+}$ ions present in the aquous micro-drops of the micro-emulsion in accordance with the following reaction:

$$16NdCl_3+76FeCl_2+200NaBH_4 \rightarrow Nd_{1.6}Fe_{76}B_8+192B+200NaCl+400H_2$$

Although the size is restricted by the volume of the micro-drop, the final structure of the micro-particle obtained depends on the process followed whilst mixing the products and on the concentrations used.

EXAMPLE

In the case mentioned above, the process used was the following: 50 ml of the micro-emulsion having the characteristics mentioned is prepared, ([AOT]=0.1 M, R=30, T=25° C., substituting the water for an aqueous solution 1,000 M in $Fe_2+$ and 0.2105 M in $Nd^3+$), and this is inserted into a bath with the thermostat set at 25° C. Then 0.0439 g of $NaBH_4(s)$ is added and is shaken strongly. The precipitate obtained is vacuum filtered and washed with water and acetone. Both the water used in the solution and the components of the micro-emulsion were previously deoxygenated by $N_2$ air-bubbling.

Figure 1:
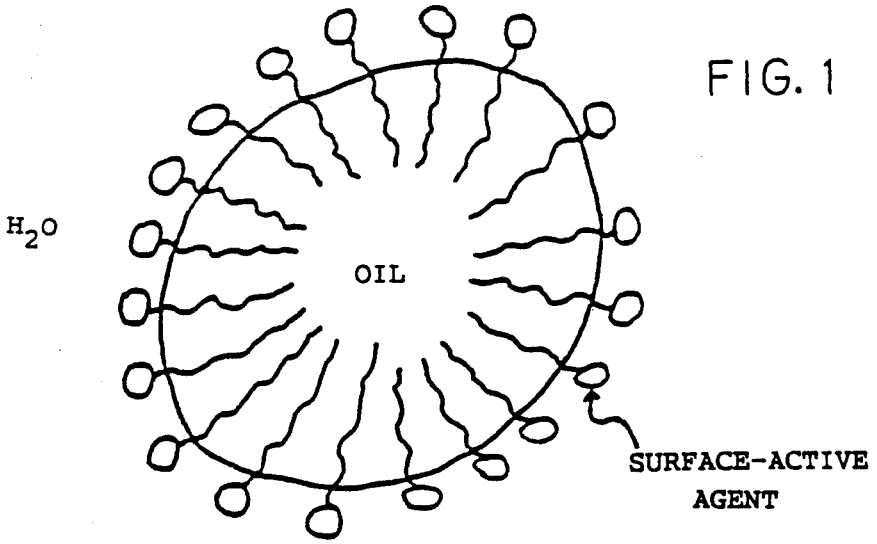
Figure 2:
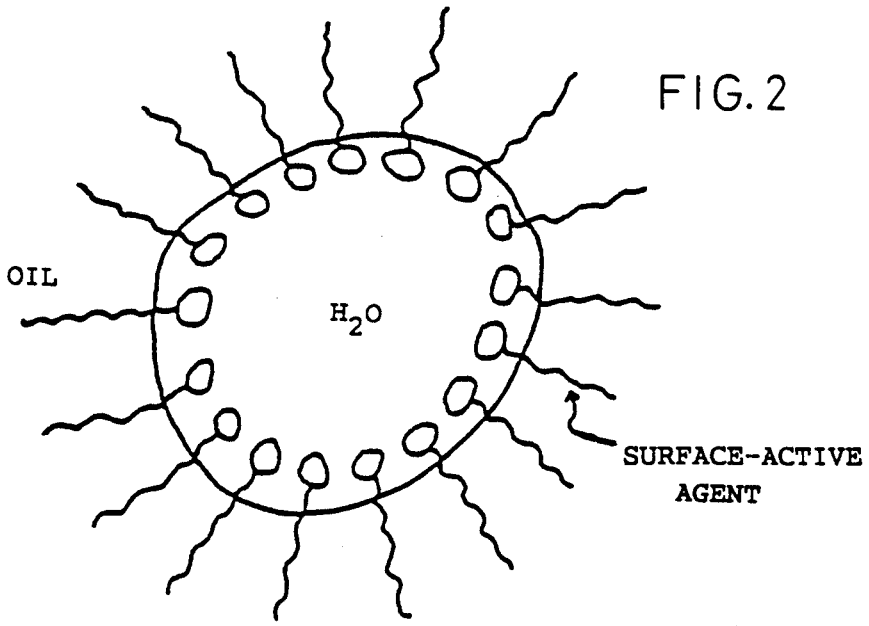
Figure 3:
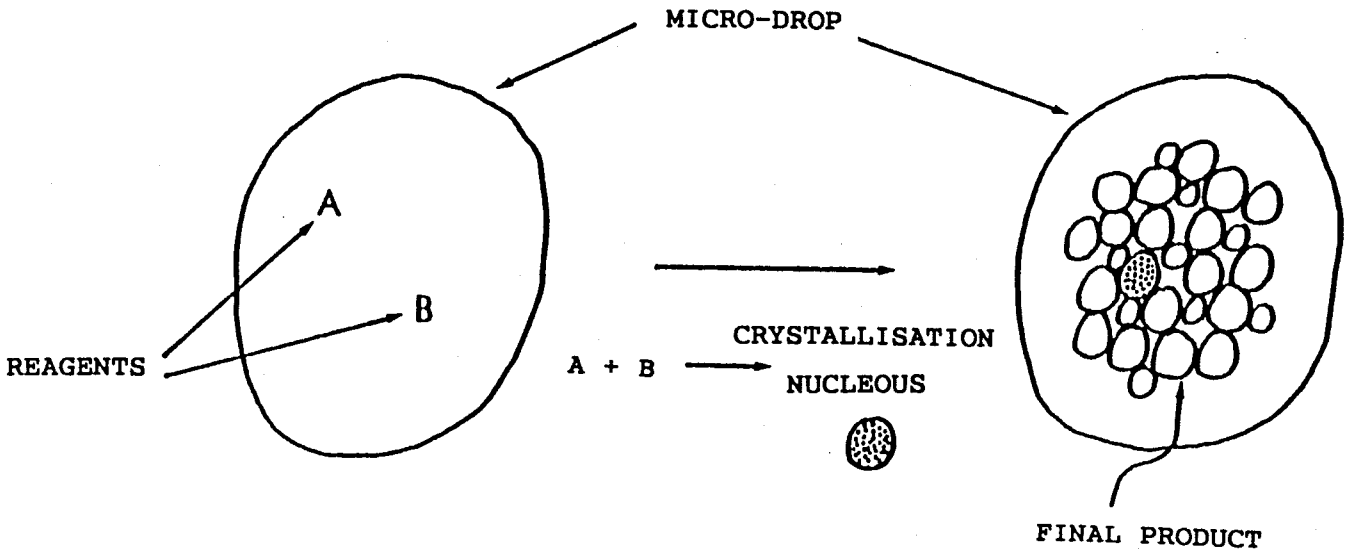
Figure 4:
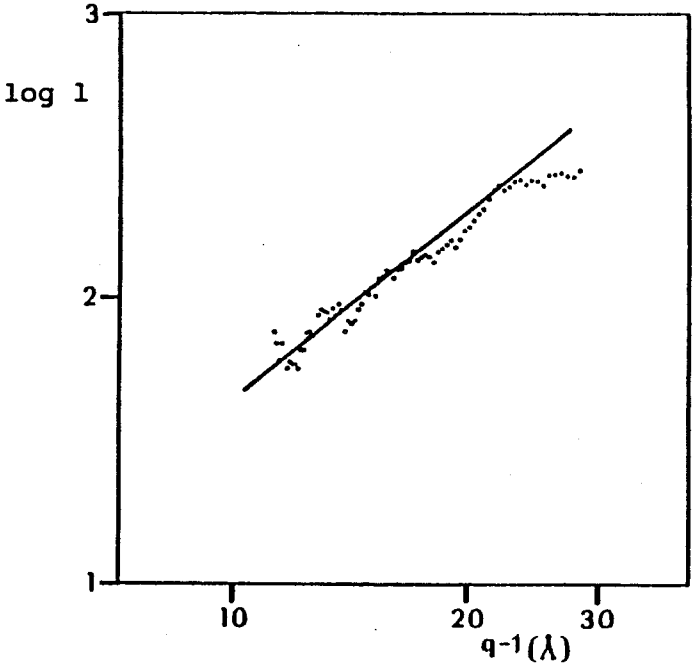

By means of this process, micro-particles were obtained which, when analysed by fine angle X-rays, showed an amorphic structure, characterised by having a surface fractile size of 2.3 (FIG. 4).

Although the present invention has been described in connection with a preferred embodiment thereof, many other variations and modifications will now become apparent to those skilled in the art without departing from the scope of the invention. It is preferred therefore, that the present invention not be limited by the specific disclosure herein, but only by the appended claims.

What is claimed is:

1. A process for producing ultra fine, magnetic neodymium-iron-boron particles, said process comprising the steps of:

forming a micro-emulsion, said micro-emulsion comprising a discontinuous phase and a continuous phase, said discontinuous phase containing neodymium-, iron- and boron-containing compounds, and reacting said neodymium-, iron- and boron-containing compounds in said discontinuous phase to form said neodymium-iron-boron particles therein.

2. The process of claim 1, wherein said discontinuous phase comprises an aqueous solution of said neodymium- and iron-containing compounds, and said boron-containing compound is added to said emulsion to form said neodymium-iron-boron particles therein.

3. The process of claim 1, wherein said micro-emulsion is a water in oil emulsion, and includes a surface active agent.

4. The process of claim 3, wherein said micro-emulsion comprises a water in isoctane emulsion.

5. The process of claim 4, wherein said surface active agent comprises bis (2-ethylhexyl) sodium sulfosuccinate.

6. The process of claim 5, wherein said micro-emulsion includes said water and said bis (2-ethylhexyl) sodium sulfosuccinate in a ratio of about 30 to 1.

7. The process of claim 6, wherein said micro-emulsion has a temperature of about 25° C.

8. The process of claim 1, wherein said neodymium-containing compound is neodymium chloride.

9. The process of claim 1, wherein said iron-containing compound is iron chloride.

10. The process of claim 1, wherein said boron-containing compound is sodium borohydride.

11. The process of claim 10, wherein said aqueous solution contains a ratio of iron ions to neodymium ions of about 76/16.

* * * * *